US009366139B2

(12) United States Patent
Kishida et al.

(10) Patent No.: US 9,366,139 B2
(45) Date of Patent: Jun. 14, 2016

(54) REPAIR METHOD OF PLATE MEMBER, PLATE MEMBER, COMBUSTOR, RING SEGMENT, AND GAS TURBINE

(71) Applicant: MITSUBISHI HEAVY INDUSTRIES, LTD., Tokyo (JP)

(72) Inventors: Hiroaki Kishida, Tokyo (JP); Mitsuo Hasegawa, Tokyo (JP); Takashi Maruo, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 452 days.

(21) Appl. No.: 13/859,240

(22) Filed: Apr. 9, 2013

(65) Prior Publication Data

US 2014/0298815 A1 Oct. 9, 2014

(51) Int. Cl.

| | |
|---|---|
| ***F23R 3/06*** | (2006.01) |
| ***F01D 9/02*** | (2006.01) |
| ***F01D 5/00*** | (2006.01) |
| ***F23R 3/00*** | (2006.01) |

(52) U.S. Cl.

CPC ..... *F01D 5/005* (2013.01); *F23R 3/002* (2013.01); *F23R 3/005* (2013.01); *F23R 3/06* (2013.01); *F01D 9/023* (2013.01); *F05D 2260/204* (2013.01); *Y10T 29/49229* (2015.01)

(58) Field of Classification Search

CPC ..... F01D 5/005; F01D 9/023; F01D 2260/04; F23R 3/002; F23R 3/005; F23R 3/06; F23D 2214/00; Y10T 29/49229

See application file for complete search history.

(56) References Cited

U.S. PATENT DOCUMENTS

| | | | | |
|---|---|---|---|---|
| 6,282,905 | B1 * | 9/2001 | Sato | F23R 3/002 60/752 |
| 6,283,356 | B1 | 9/2001 | Messelling | |
| 6,546,627 | B1 * | 4/2003 | Sekihara | B23P 6/005 29/402.08 |

(Continued)

FOREIGN PATENT DOCUMENTS

| | | |
|---|---|---|
| JP | 7-62893 A | 3/1995 |
| JP | 9-89489 A | 4/1997 |

(Continued)

OTHER PUBLICATIONS

Written opinion of PCT/JP2013/060757 dated Jun. 18, 2013 with English Translation. (8 pages).

ISR of PCT/JP2013/060757 dated Jun. 18, 2013 with English Translation. (3 pages).

(Continued)

*Primary Examiner* — Carlos A Rivera

(74) *Attorney, Agent, or Firm* — Westerman, Hattori, Daniels & Adrian, LLP

(57) ABSTRACT

A repair method of a plate member disposed so as to separate a high-pressure space and a low-pressure space and having a cooling passage provided inside thereof along a surface thereof, comprising: removing a damaged portion generated in the plate member so as to expose the cooling passage; primarily filling an area where a material is removed so as to block the cooling passage and form an external shape of the plate member having no missing portion as compared to its original external shape; forming a first opening through which the cooling passage communicates with the low-pressure space on an upstream side, in a flow direction of a refrigerant in the cooling passage, of a position where the cooling passage is blocked; and forming a second opening through which the cooling passage communicates with the high-pressure space on a downstream side of the position where the cooling passage is blocked.

13 Claims, 14 Drawing Sheets

(56) References Cited

U.S. PATENT DOCUMENTS

| | | | | |
|---|---|---|---|---|
| 6,615,470 | B2 | 9/2003 | Corderman et al. | |
| 7,146,725 | B2 * | 12/2006 | Kottilingam | B23K 10/027 29/402.11 |
| 2010/0242487 | A1 * | 9/2010 | Davis, Jr. | F01D 9/023 60/772 |
| 2010/0316492 | A1 * | 12/2010 | Charron | F01D 9/023 415/182.1 |
| 2012/0186254 | A1 * | 7/2012 | Ito | B23K 1/0018 60/722 |
| 2012/0272611 | A1 | 11/2012 | Tsukimoto et al. | |
| 2013/0098063 | A1 * | 4/2013 | Mizukami | F01D 9/023 60/785 |

FOREIGN PATENT DOCUMENTS

| | | | |
|---|---|---|---|
| JP | 2001-115857 | A | 4/2001 |
| JP | 2001-277057 | A | 10/2001 |
| JP | 2002-361523 | A | 12/2002 |
| JP | 2003-176727 | A | 6/2003 |
| JP | 2008-200836 | A | 9/2008 |
| JP | 2011-147952 | A | 8/2011 |
| JP | 2013-107186 | A | 6/2013 |

OTHER PUBLICATIONS

Notice of Allowance dated Nov. 17, 2015, issued in counterpart Japanese Application No. 2011-256389, English translation.(3 pages).

* cited by examiner

REPAIR METHOD OF PLATE MEMBER, PLATE MEMBER, COMBUSTOR, RING SEGMENT, AND GAS TURBINE

TECHNICAL FIELD

The present invention relates to a repair method of a plate member, a plate member, and a combustor, a ring segment, and a gas turbine which are provided with the plate member.

BACKGROUND ART

A combustor of a gas turbine includes a transition piece which sends high-temperature and high-pressure combustion gas to a turbine.

A shell plate which forms the transition piece has a structure in which cooling air is led inside, in order to prevent burnout due to exposure to high-temperature combustion gas. Specifically, a plurality of cooling air passages extending in a direction along an axis of the transition piece is formed in the shell plate, and a cooling air inlet opened to the outer periphery side of the shell plate and a cooling air outlet opened to the inner periphery side of the shell plate are formed on each of the plurality of cooling air passages. Cooling air enters from the cooling air inlet on the outer periphery side of the transition piece into the cooling air passage and then comes out from the cooling air outlet to the inner periphery side of the transition piece.

There is a concern that a crack having a linear shape or the like may be generated in the transition piece of the combustor of the gas turbine having the above-described structure due to thermal cycle fatigue, etc. during operation. As a repair method of such a crack, a repair method as described in Patent Document 1 is known. That is, the repair method includes a groove formation process of removing a crack generation portion, thereby providing a groove for welding, a clogging process of clogging up a bottom portion of the groove by welding, and a cover attachment process of mounting a cover plate on an opening portion of the groove, which is carried out after the clogging process is carried out.

PRIOR ART DOCUMENT

Patent Document

[Patent Document 1] Japanese Unexamined Patent Application, First Publication No. 2002-361523

DISCLOSURE OF THE INVENTION

Problem that the Invention is to Solve

However, in the above-described repair method, since a cover plate having an appropriate shape should be prepared for each repair according to the shape of a crack that is a repair target and it is necessary to make the dimensions of the groove correspond to the cover plate, work for forming the groove becomes complicated. For this reason, long time is required for repair work, and thus there is a problem in that delivery time cannot be shortened and in addition, a repair cost increases.

The present invention has been made in consideration of such circumstances and an object thereof is to provide a repair method of a plate member which can be carried out in a short time and at low cost while securing the cooling performance of a cooling air passage.

Means for Solving the Problems

According to an aspect of the invention, there is provided a repair method of a plate member disposed so as to separate a high-pressure space and a low-pressure space and having a cooling passage provided inside thereof along a surface of the plate member, the repair method including the steps of: removing a damaged portion generated in the plate member so as to expose the cooling passage; primarily filling an area where a material of the plate member is removed so as to block the exposed cooling passage and form an external shape of the plate member having no missing portion as compared to its original external shape; forming a first opening through which the cooling passage is communicated with the low-pressure space on an upstream side, in a flow direction of a refrigerant in the cooling passage, of a position where the cooling passage is blocked; and forming a second opening through which the cooling passage is communicated with the high-pressure space on a downstream side, in the flow direction of the refrigerant in the cooling passage, of the position where the cooling passage is blocked.

According to the above configuration, it is possible to repair a damaged portion in an easy way and also it is possible to make working fluid flow to each of the upstream side and the downstream side with respect to the damaged portion of the cooling passage.

In this way, the cooling passage is not blocked due to the repair of the damaged portion, and thus, decreases in functions such as cooling can be prevented. In addition, work to prepare a cover plate according to the shape of a crack that is a repair target or to form a groove corresponding to the cover plate is not required. For this reason, it is possible to repair the plate member in a short time and at low cost while securing the cooling performance of the cooling passage.

Further, in the repair method of a plate member described above, it is preferable that in the step of forming the first opening, the first opening is provided by forming a through-hole that penetrates from a surface on the high-pressure space side of the plate member to a surface on the low-pressure space side of the plate member, and the repair method further includes the step of secondarily filling and blocking a portion through which the high-pressure space is communicated with the cooling passage in the through-hole.

According to the above configuration, even in a case where an access direction of a tool for forming an opening is limited to only a direction from the high-pressure space side, the repair method according to the invention can be used.

Further, it is preferable that the repair method of a plate member described above further includes the step of marking on positions where the first and second openings are to be formed, wherein the step of marking is performed between the steps of removing and primary filling.

According to the above configuration, the step of forming the first opening and the step of forming the second opening can be easily and reliably carried out by specifying places where the openings are to be provided, by referring to the position of the cooling passage exposed in advance.

According to another aspect of the invention, there is provided a plate member disposed so as to separate a high-pressure space and a low-pressure space and having a cooling passage provided inside thereof along a surface of the plate member, the plate member including: a filling member filled in an area where a material of the plate member is removed so as to expose the cooling passage; a first opening which is formed on a low-pressure space side of the plate member and through which the cooling passage communicates with the low-pressure space on an upstream side of the filling member in a flow direction of a refrigerant flowing in the cooling passage; and a second opening which is formed on a high-pressure space side of the plate member and through which the cooling passage communicates with the high-pressure space on a downstream side of the filling member in the flow direction of the refrigerant flowing in the cooling passage.

Furthermore, the plate member described above may be configured to further include a blocking member configured to block a through-hole formed in the plate member from the low-pressure space to the high-pressure space at a position corresponding to the first opening, farther on the high-pressure space side than a position where the through-hole intersects the cooling passage.

Further, according to another aspect of the invention, there is provided a combustor of a gas turbine including the above-described plate member.

Further, in the combustor of a gas turbine described above, it is preferable that the combustor includes the plate member formed into a tubular shape, the plate member is configured by bonding a plurality of plates which includes at least one plate with a groove formed in a surface thereof, the high-pressure space is a space at the inside of a casing of the gas turbine and the outside of the combustor, and the low-pressure space is a space at the inside of the combustor.

Further, according to still another aspect of the invention, there is provided a ring segment which includes the above-described plate member.

Further, according to yet another aspect of the invention, there is provided a gas turbine which includes at least one of the above-described combustor and the above-described ring segment.

Effects of the Invention

According to the invention, it is possible to repair a damaged portion in an easy way and also it is possible to make working fluid flow to each of the upstream side and the downstream side with respect to the damaged portion of the cooling passage. In this way, the cooling passage is not blocked due to the repair of the damaged portion, and thus a decrease in cooling function can be prevented. In addition, work to prepare a cover plate according to the shape of a crack that is a repair target or to form a groove corresponding to the cover plate is not required. For this reason, it is possible to repair the plate member in a short time and at low cost while securing the cooling performance of the cooling passage.

BEST MODE FOR CARRYING OUT THE INVENTION

Figure 1:
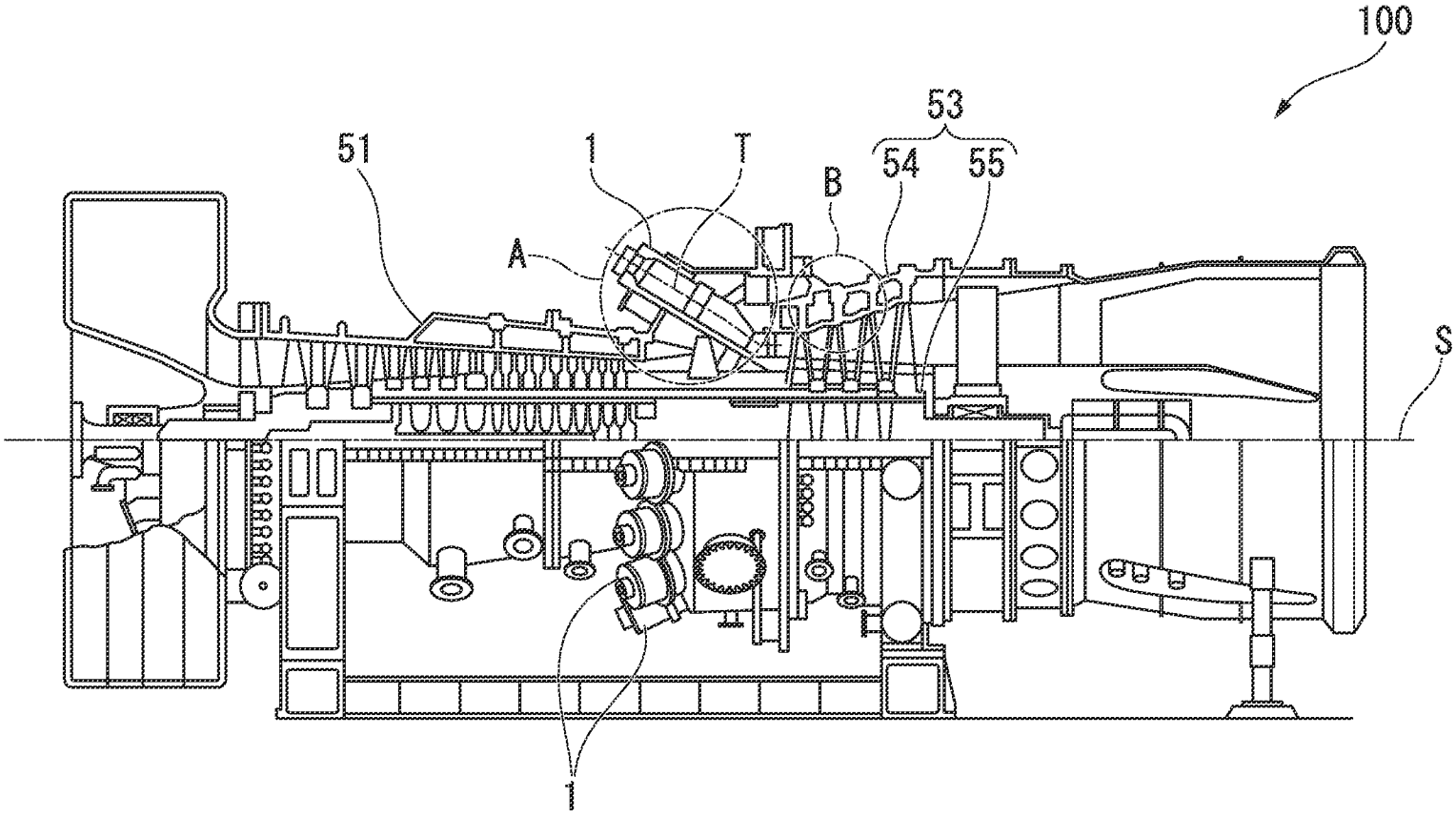
FIG. 1 is an overall side view with a main section cut away, of a gas turbine according to an embodiment of the invention.

Hereinafter, a repair method of a plate member according to embodiments of the invention will be described in detail by referring to the drawings. Hereinafter, the repair method of a plate member according to the present embodiment will be described by applying the method to a shell plate configuring a transition piece of a gas turbine. However, the invention is not limited thereto and can be applied to repair of a plate member which is disposed so as to separate a high-pressure space and a low-pressure space and in which a cooling passage along a surface of the plate member is provided inside thereof.

A gas turbine 100 in this embodiment includes a compressor 51 which compresses external air, thereby generating compressed air, a plurality of combustors 1 which mixes fuel from a fuel supply source with the compressed air and burns the mixture, thereby generating combustion gas, and a turbine 53 which is driven by the combustion gas, as shown in FIG. 1.

The turbine 53 includes a casing 54, and a turbine rotor 55 which rotates in the casing 54. The turbine rotor 55 is connected to, for example, an electric generator (not shown) which generates electricity by rotation of the turbine rotor 55. The plurality of combustors 1 is fixed to the casing 54 at equal intervals with respect to one another in a circumferential direction around an axis of rotation S of the turbine rotor 55.

Figure 2:
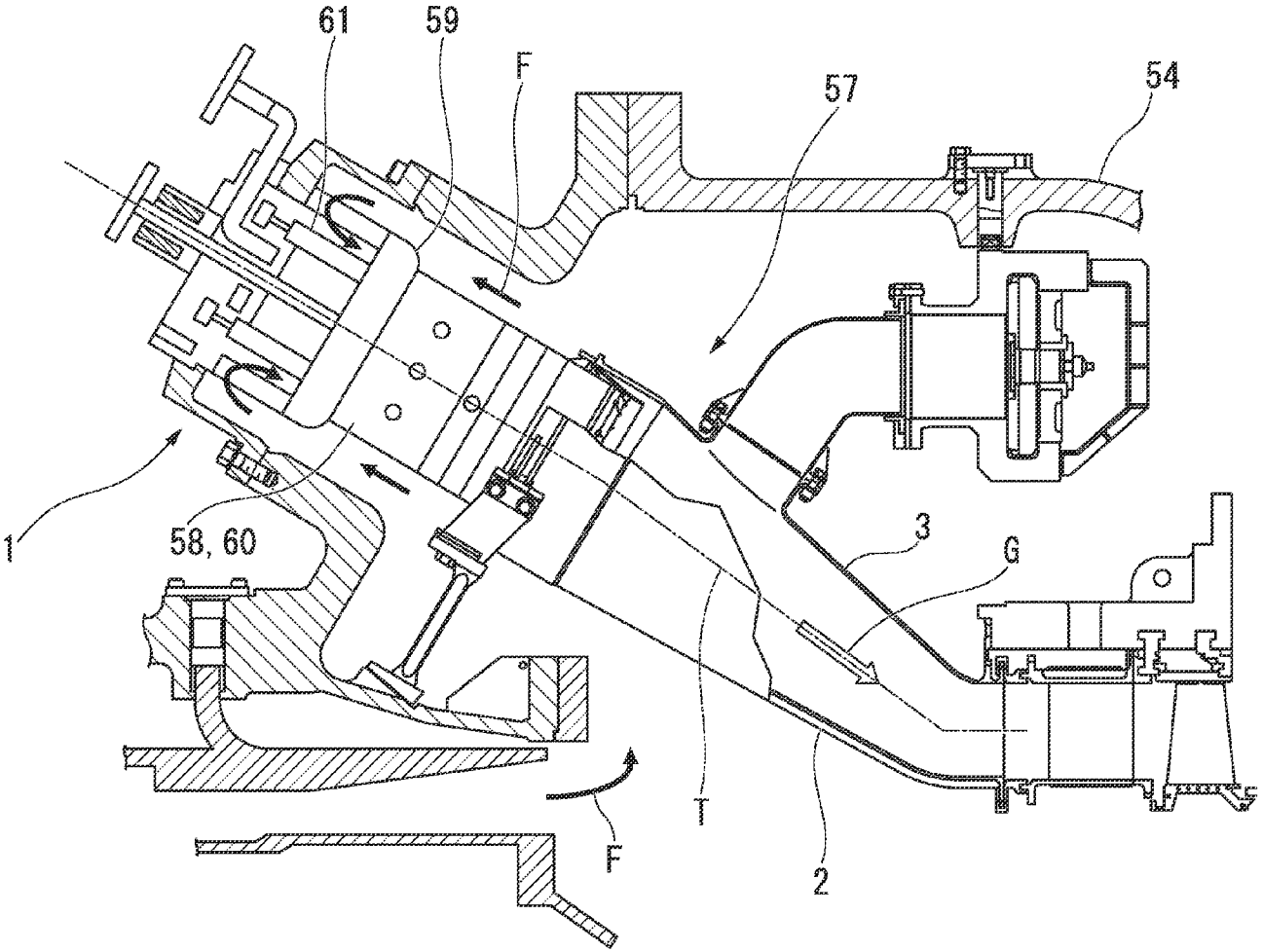
FIG. 2 is an enlarged view of portion A of FIG. 1.

As shown in FIG. 2, the combustor 1 includes a combustor basket 58 accommodated in a casing chamber 57, a fuel feeder 59 provided at a base end portion of the combustor basket 58 and provided with a fuel nozzle 61, and a transition piece 2 of which a tip portion is connected to the combustor basket 58. The combustor basket 58 is a tubular member which forms an inner wall surface of a combustion chamber 60. The transition piece 2 has an external shape which is formed by a shell plate 3 formed into a tubular shape around an axis T.

Figure 3:
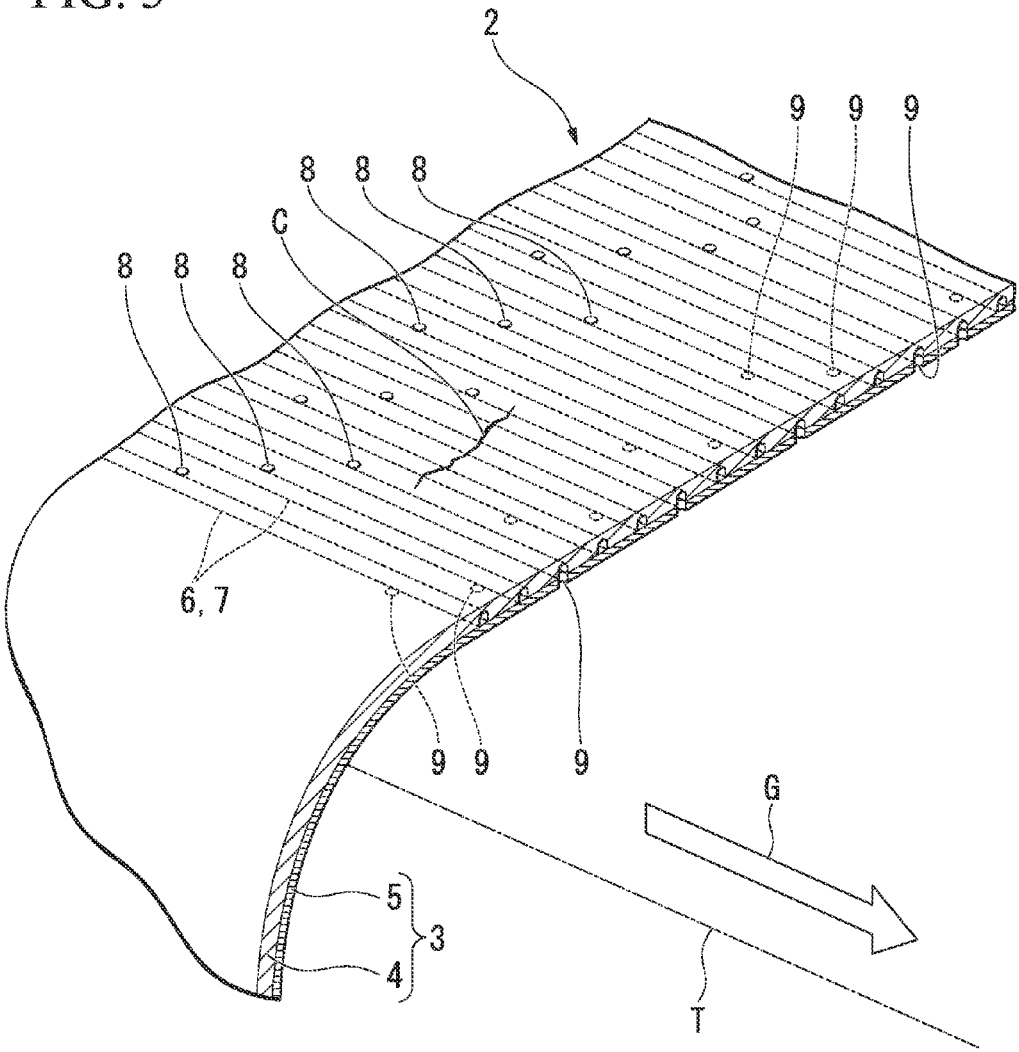
FIG. 3 is a perspective view with a main section cut away, of a transition piece according to the embodiment of the invention.

As shown in FIG. 3, the shell plate 3 which forms the transition piece 2 is formed by performing bending work on a material formed by joining an outer shell plate 4 and an inner shell plate 5, which are two plates. In the inner peripheral surface of the outer shell plate 4 forming the outer periphery side of the shell plate 3, of the two plates configuring the shell plate 3, a plurality of stripe-shaped grooves 6 recessed to the outer periphery side and extending in a direction along the axis T is formed. The inner shell plate 5 that is the other plate of the two plates configuring the shell plate 3 is joined to the inner peripheral surface of the outer shell plate 4. An opening of the stripe-shaped groove 6 formed in the outer shell plate 4 is closed by the inner shell plate 5, thereby forming a cooling air passage 7.

In the shell plate 3, a cooling air inlet 8 opened to the outer periphery side of the shell plate 3, that is, the casing chamber 57 side thereof and a cooling air outlet 9 opened to the inner periphery side of the shell plate 3, that is, the combustion chamber 60 side thereof are formed for each of the plurality of cooling air passages 7. That is, the shell plate 3 is a plate member in which the cooling air passage 7 of which one end is opened to the casing chamber 57 side of the shell plate 3 and the other end is opened to the combustion chamber 60 side of the shell plate 3 is provided along a surface of the shell plate 3.

Most of compressed air F from the compressor 51 is sent into the fuel feeder 59 of the combustor 1 and jetted from the fuel feeder 59 into the transition piece 2 along with fuel, as shown in FIG. 2. In the transition piece 2, the fuel burns, whereby combustion gas G having high temperature is generated. The combustion gas G having high temperature flows from the transition piece 2 into the turbine 53 and rotates the turbine rotor 55.

Further, some of the compressed air F from the compressor 51 flows from the outer periphery side of the transition piece 2 through the cooling air inlets 8, the cooling air passages 7, and the cooling air outlets 9 of the transition piece 2 into the transition piece 2 as cooling air. That is, the compressed air F flows from the casing chamber 57 that is a high-pressure chamber to the inside (the combustion chamber 60 side of the shell plate 3) of the transition piece 2 that is a low-pressure chamber as cooling air. At this time, heat given from the high-temperature combustion gas G to the transition piece 2 is transmitted to the cooling air through the inner surface of the cooling air passage 7. In this way, an excessive increase in the temperature of the shell plate 3 configuring the transition piece 2 is prevented.

Next, a repair method of the shell plate 3 will be described. FIGS. 5A, 6A, 7A, 8A, 9A, and 10A are plan views when the shell plate 3 is viewed from the casing chamber 57 side thereof, and FIGS. 5B, 6B, 7B, 8B, 9B, and 10B are cross-sectional views of the shell plate 3.

Figure 4:
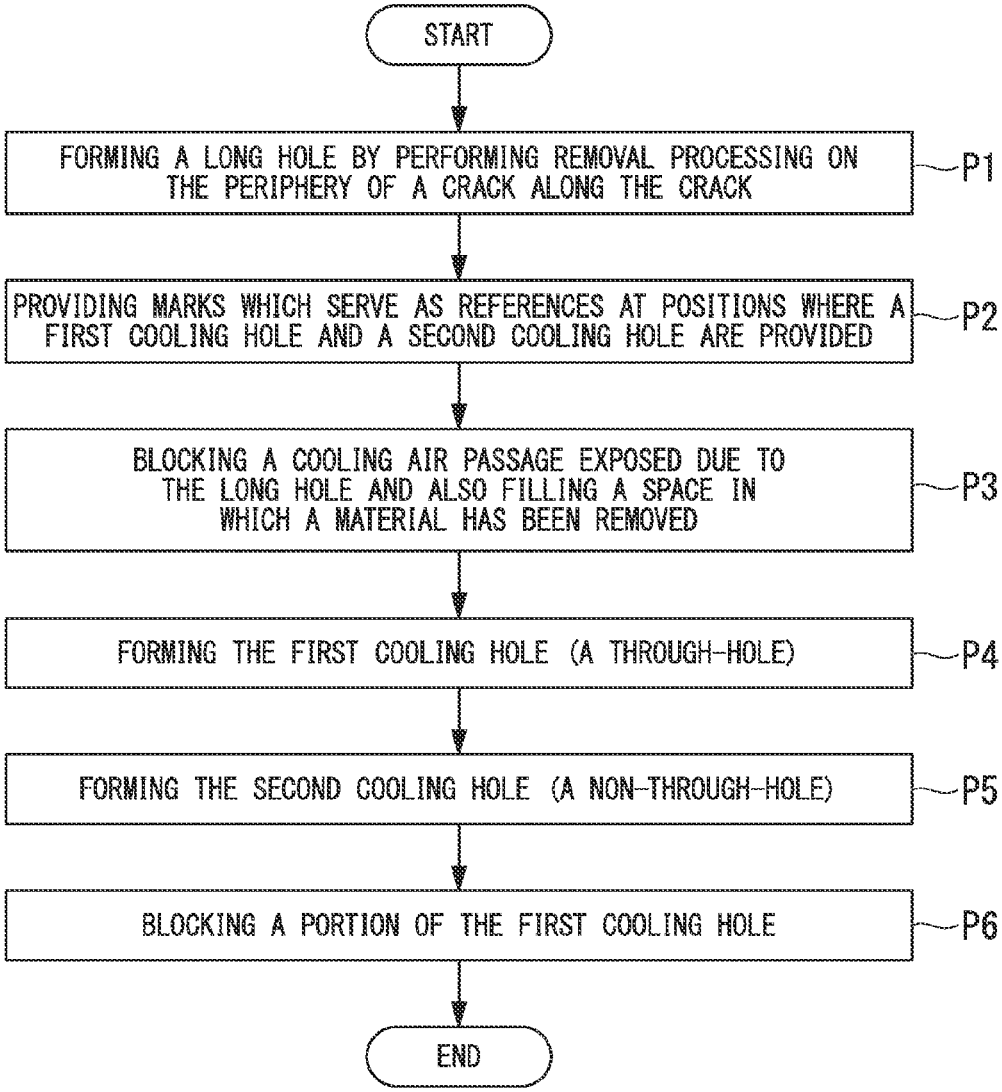
FIG. 4 is a flowchart of a repair method according to the embodiment of the invention.
Figure 5A:
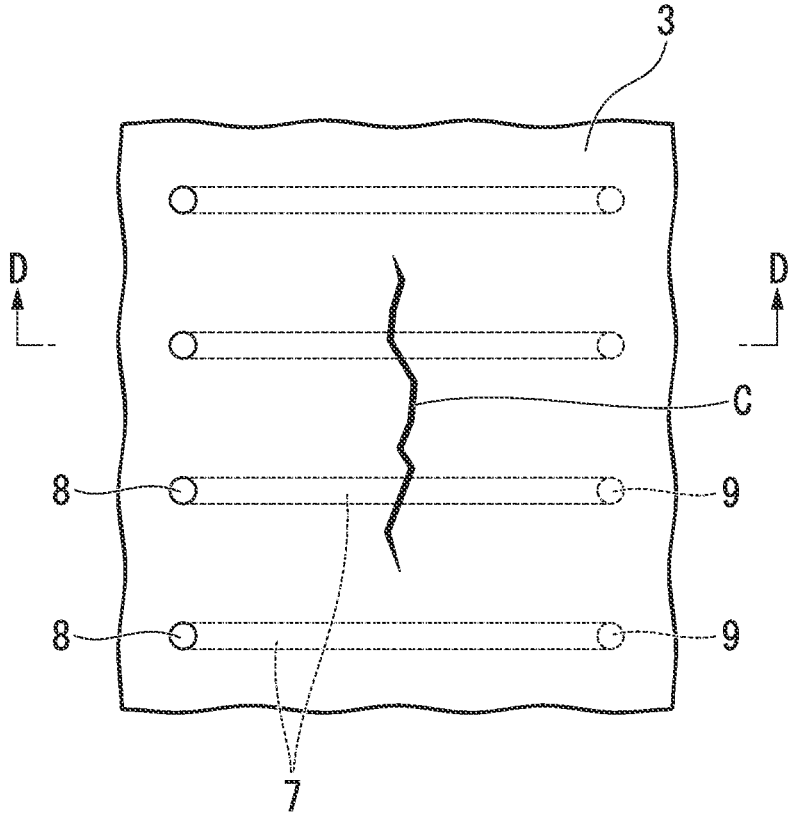
FIG. 5A is a plan view of a shell plate of the transition piece, as viewed from the casing chamber side thereof.
Figure 5B:
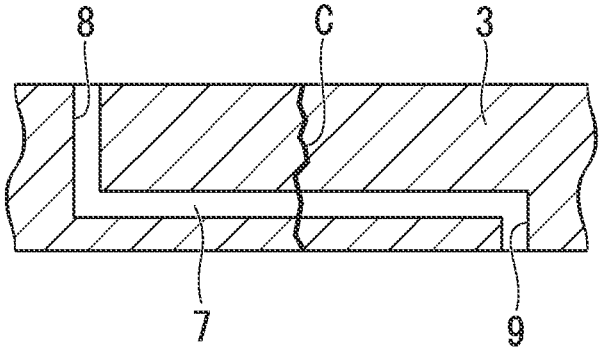
FIG. 5B is a cross-sectional view taken along line D-D of FIG. 5A.

The repair method according to this embodiment is a repair method in a case where a linear crack C passing through the shell plate 3 with the cooling air passage 7 formed inside thereof has been generated, as shown in FIGS. 5A and 5B, and includes a step of removing P1, a step of marking P2, a step of primary filling P3, a step of forming a first opening P4, a step of forming a second opening P5, and a step of secondary filling P6 in this order, as shown in a flowchart of FIG. 4.

As shown in FIG. 5A, the crack C passes through the shell plate 3 across two cooling air passages 7 and is formed in a direction approximately perpendicular to an extending direction of the cooling air passage 7. In addition, the length or a forming direction of the crack C is not limited thereto.

In the following description, from the viewpoint of a flow direction of the cooling air flowing in the cooling air passage 7, the left side of each of FIGS. 5A, 6A, 7A, 8A, 9A and 10A and FIGS. 5B, 6B, 7B. 8B. 9B, and 10B is referred to as an upstream side and the right side is referred to as a downstream side. Further, the side to which the cooling air inlet 8 is opened is referred to as the casing chamber 57 side, and the side to which the cooling air outlet 9 is opened is referred to as the combustion chamber 60 side.

Figure 6A:
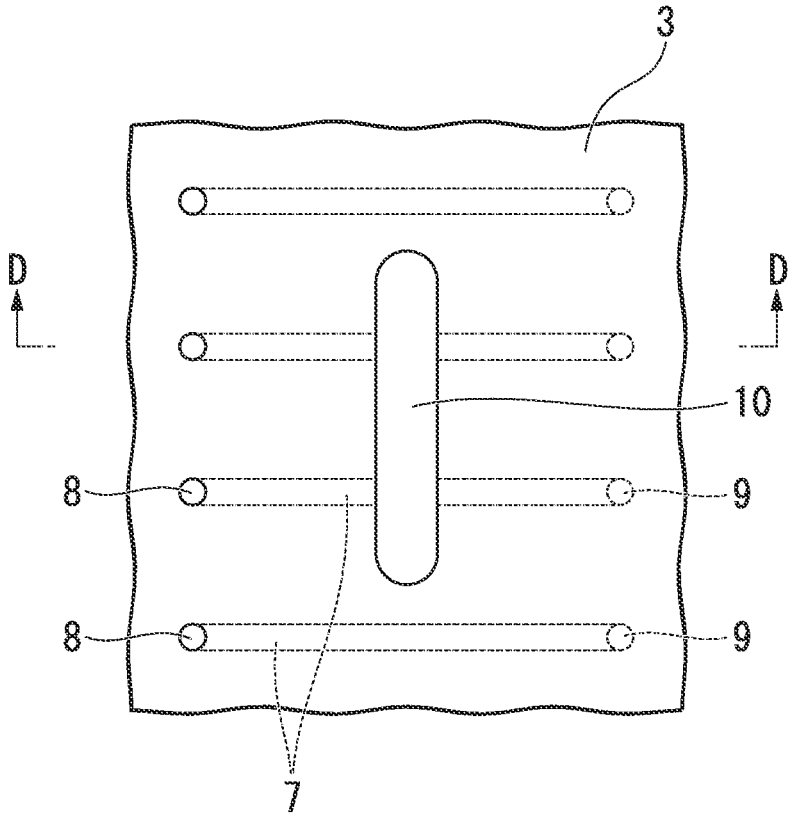
FIG. 6A is a diagram describing a step of removing in a repair method of the shell plate and a plan view of the shell plate, as viewed from the casing chamber side thereof.
Figure 6B:
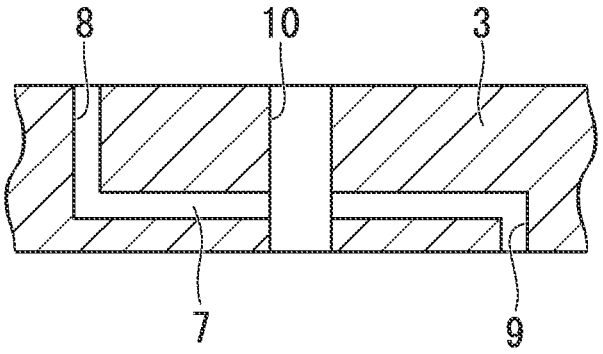
FIG. 6B is a cross-sectional view taken along line D-D of FIG. 6A.

As shown in FIGS. 6A and 6B, the step of removing P1 is a process of removing the periphery of the crack C (a crack C generation portion) along the crack C generated in the shell plate 3 by using a grinder or the like. A long hole 10 which is formed by the step of removing is formed so as to pass through the shell plate 3 to the inside of the transition piece 2, that is, the combustion chamber 60 side by making the grinder or the like access from the outside of the transition piece 2, that is, the casing chamber 57 side.

Figure 7A:
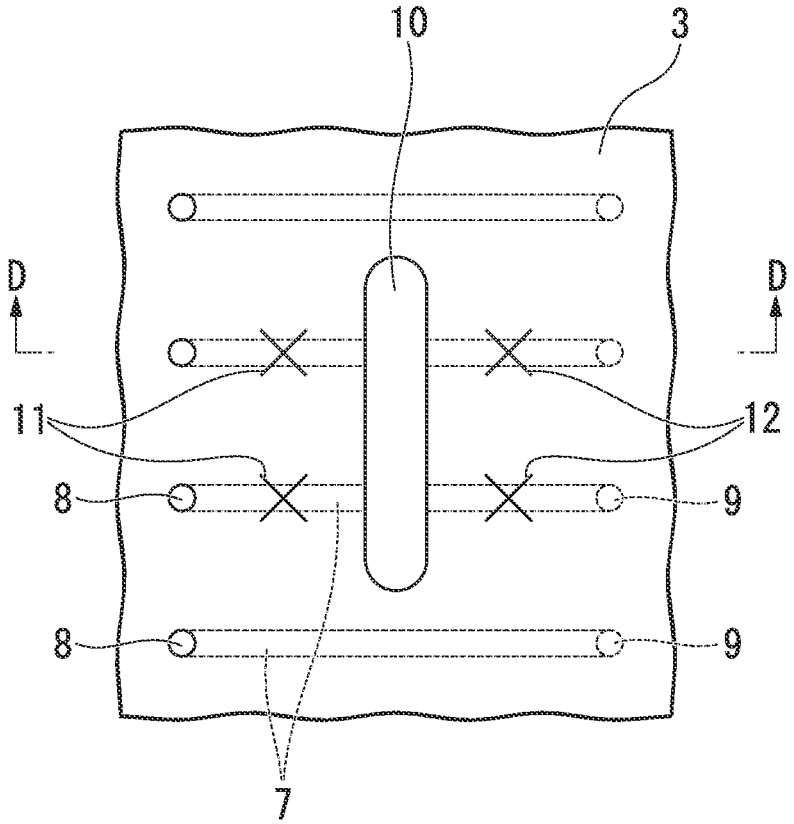
FIG. 7A is a diagram describing a step of marking in the repair method of the shell plate and a plan view of the shell plate, as viewed from the casing chamber side thereof.
Figure 7B:
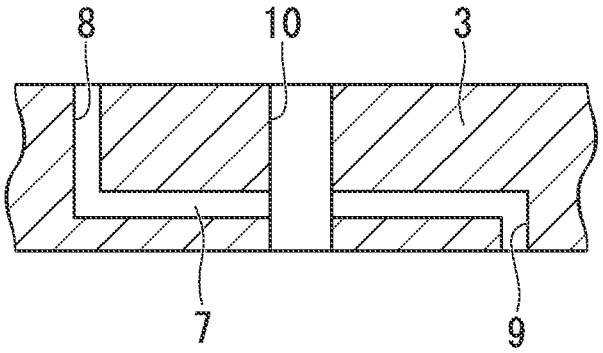
FIG. 7B is a cross-sectional view taken along line D-D of FIG. 7A.

As shown in FIGS. 7A and 7B, the step of marking P2 is a process of providing marks which serve as references, on positions where a first cooling hole 13 and a second cooling hole 14, both of which will be described later, are to be formed. The marks include a first mark 11 corresponding to the first cooling hole 13 and a second mark 12 corresponding to the second cooling hole 14, and the first mark 11 is written on the upstream side of a place where the crack C is formed and the second mark 12 is written on the downstream side of the place where the crack C is formed.

Specifically, the first mark 11 and the second mark 12 are written on positions which are spaced by a predetermined distance from the inner peripheral surface of the long hole 10 and are equivalent to directly above the cooling air passage 7, with the position of the cooling air passage 7 exposed to the inner peripheral surface of the long hole 10 formed by the step of removing as a standard, by using a scriber or the like. One first mark 11 is written for each cooling air passage 7 at a position directly above the corresponding exposed cooling air passage 7, and similarly, one second mark 12 is written for each cooling air passage 7 at a position equivalent to directly above the corresponding exposed cooling air passage 7. That is, in a case where two cooling air passages 7 are exposed to the inner peripheral surface of the long hole 10, two first marks 11 are written and two second marks 12 are written. In FIG. 7A, the two first marks 11 (or the two second marks 12) are written so as to be parallel to the long hole 10. However, the distances of the respective first marks 11 (or the respective second marks 12) from the long hole 10 may be different from each other.

Figure 8A:
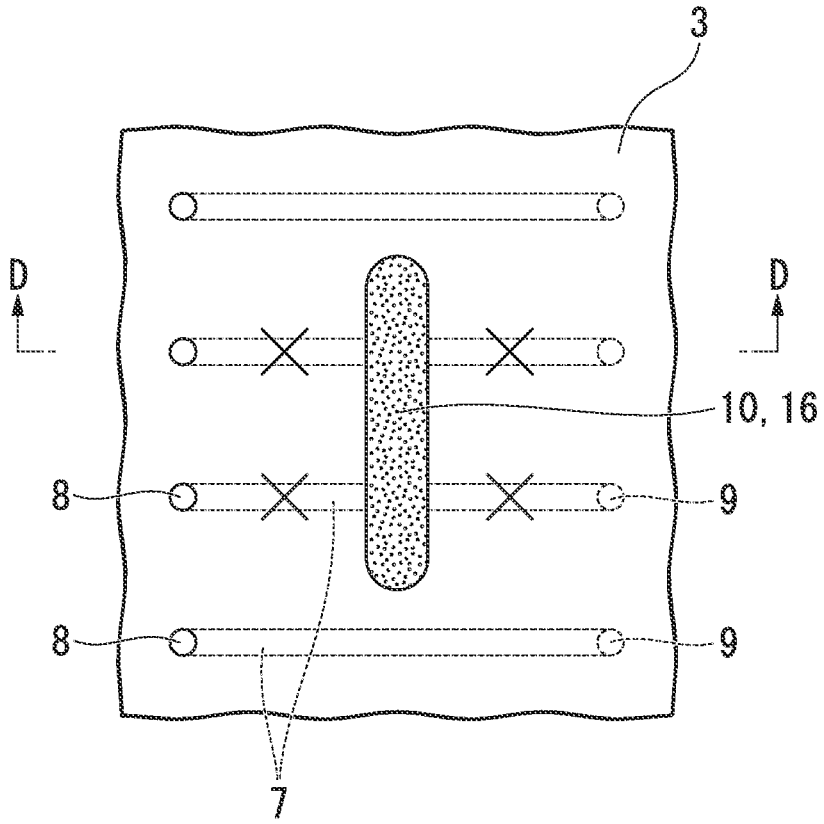
FIG. 8A is a diagram describing a step of primary filling in the repair method of the shell plate and a plan view of the shell plate, as viewed from the casing chamber side thereof.
Figure 8B:
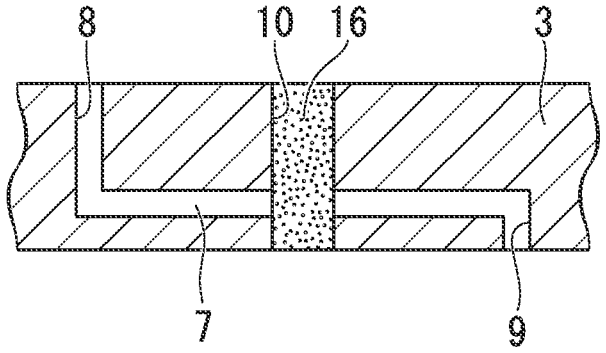
FIG. 8B is a cross-sectional view taken along line D-D of FIG. 8A.

As shown in FIGS. 8A and 8B, the step of primary filling P3 is a process of filling the long hole 10, that is, a space in which a material of the shell plate 3 has been removed by the step of removing, so as to block the cooling air passage 7 exposed due to the long hole 10.

Specifically, the long hole 10 is filled with weld metal 16 by welding. In this way, the shell plate 3 of the transition piece 2 is formed into an external shape having no missing portion as compared to its original external shape. As a welding method which is used in the step of primary filling P3, for example, TIG welding, MIG welding, plasma welding, carbon dioxide gas arc welding, MAG welding, or the like can be applied. However, there is no limitation thereto.

At this time, it is preferable to remove portions protruding from both surfaces of the shell plate 3, of the weld metal 16 added into the long hole 10, thereby finishing each of both surfaces of the shell plate 3 so as to become flush. In this process, as means for removing the protruding portions of the weld metal 16, common cutting and grinding means such as a grinder is adopted.

Figure 9A:
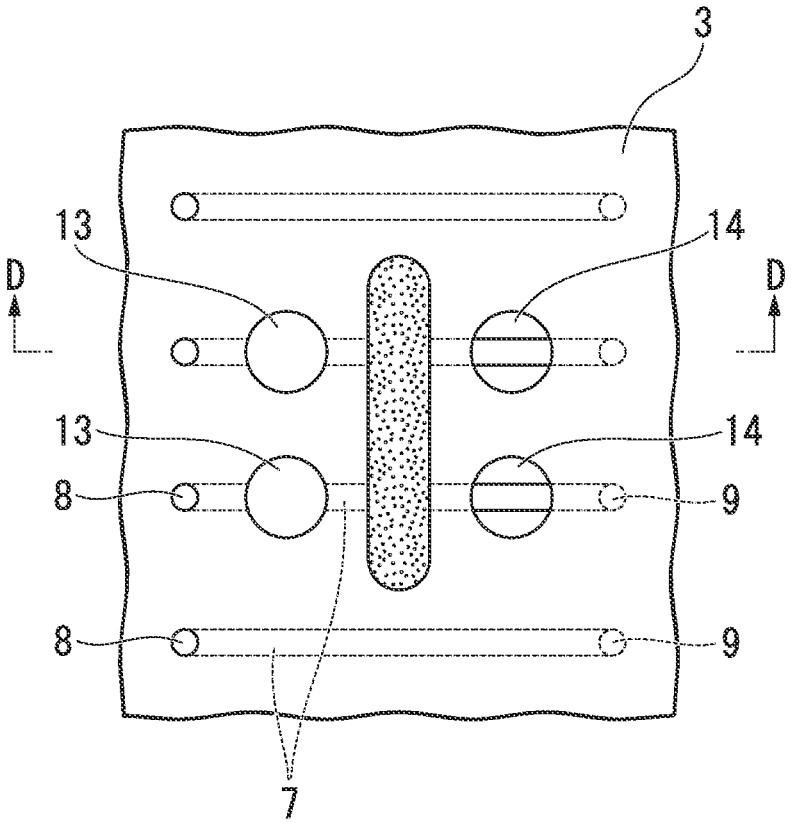
FIG. 9A is a diagram describing a step of forming a first opening and a step of forming a second opening in the repair method of the shell plate and a plan view of the shell plate, as viewed from the casing chamber side thereof.
Figure 9B:
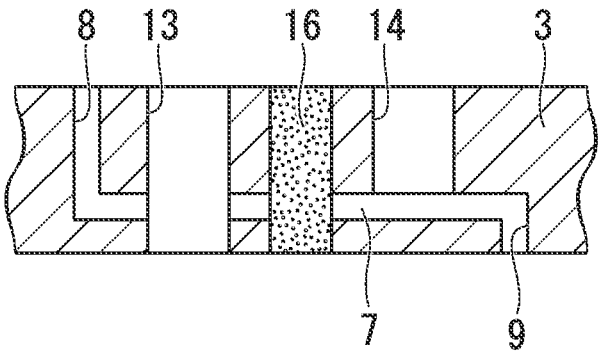
FIG. 9B is a cross-sectional view taken along line D-D of FIG. 9A.

As shown in FIGS. 9A and 9B, the step of forming the first opening P4 and the step of forming the second opening P5 are processes of forming the first cooling hole 13 and the second cooling hole 14.

The step of forming the first opening P4 is a process of forming the first cooling hole 13 that is a through-hole penetrating from the casing chamber 57 side of the shell plate 3 to the combustion chamber 60 side of the shell plate 3, at the position of the first mark 11 written in the shell plate 3 directly above the cooling air passage 7 by using a drill tool or the like. The diameter of the first cooling hole 13 may be approximately the same as the width of the cooling air passage 7 and may also be sufficiently larger than the width of the cooling air passage 7 in order to reduce the complexity of work.

The step of forming the second opening P5 is a process of forming the second cooling hole 14 through which the cooling air passage 7 is communicated with the casing chamber 57, from the casing chamber 57 side at the position of the second mark 12 written in the shell plate 3 directly above the cooling air passage 7. That is, the second cooling hole 14 is not a through-hole, unlike the first cooling hole 13. The diameter of the second cooling hole 14 may be approximately the same as the width of the cooling air passage 7 and may also be sufficiently larger than the width of the cooling air passage 7.

Figure 10A:
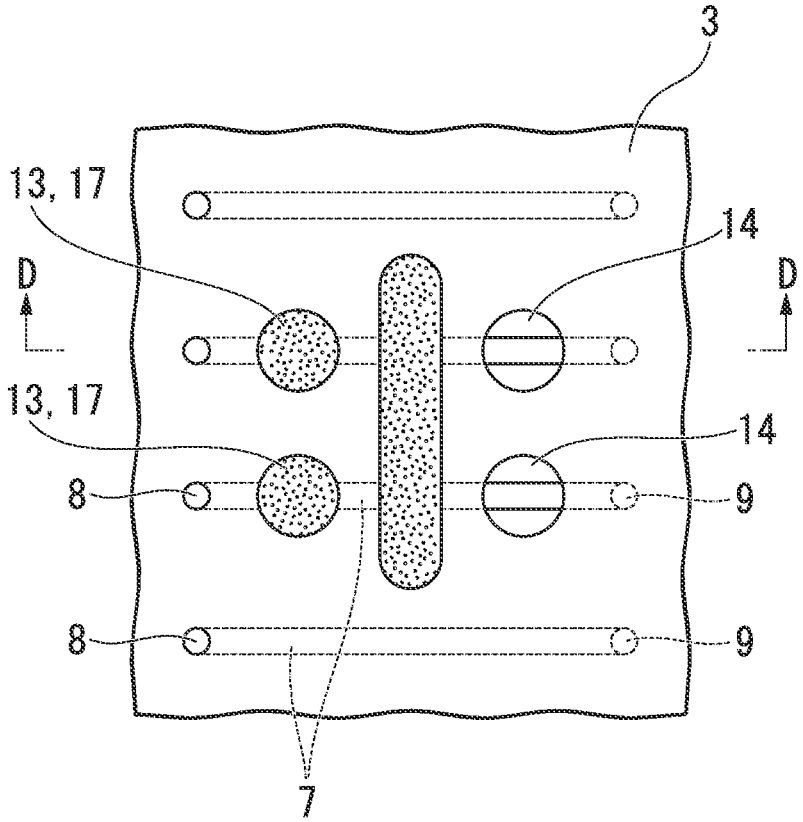
FIG. 10A is a diagram describing a step of secondary filling in the repair method of the shell plate and a plan view of the shell plate, as viewed from the casing chamber side thereof.
Figure 10B:
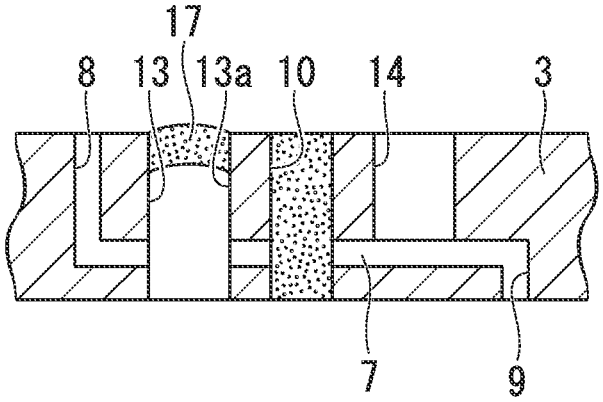
FIG. 10B is a cross-sectional view taken along line D-D of FIG. 10A.

As shown in FIGS. 10A and 10B, the step of secondary filling P6 is a process of blocking a portion of the first cooling hole 13. Specifically, a communication portion 13*a* through which the cooling air passage 7 is communicated with the casing chamber 57 in the first cooling hole 13 is filled with weld metal 17 by welding.

At this time, it is preferable to remove a portion protruding from the surface on the casing chamber 57 side of the shell plate 3, of the weld metal 17 added to the communication portion 13*a* through which the cooling air passage 7 is communicated with the casing chamber 57, thereby finishing the surface on the casing chamber 57 side of the shell plate 3 so as to become flush. In this process, as means for removing the protruding portion of the weld metal 17, common cutting and grinding means such as a grinder is adopted.

By the processes described above, the shell plate 3 of the transition piece 2 becomes a plate member having the long hole 10 that is a communication space crossing the cooling air passage 7, the weld metal 16 that is a filling member filled in the long hole 10 so as to block an opening of the cooling air passage 7 which is opened to the inner peripheral surface of the long hole 10, the first cooling hole 13 through which the cooling air passage 7 further on the upstream side than the weld metal 16 is communicated with the combustion chamber 60 side, and the second cooling hole 14 through which the cooling air passage 7 further on the downstream side than the weld metal 16 is communicated with the casing chamber 57 side of the shell plate 3.

Further, the weld metal 17 that is a blocking member is filled in the communication portion 13*a* through which the cooling air passage 7 is communicated with the casing chamber 57, of the first cooing hole 13 in the plate member.

According to the repair method of a shell plate according to the above-described embodiment, it is possible to make working fluid flow to each of the upstream side and the downstream side with respect to the crack C of the cooling air passage 7. In this way, the cooling air passage 7 is not blocked due to the repair of the crack C, and thus decreases in functions such as cooling can be prevented. In addition, work to prepare a cover plate according to the shape of a crack that is a repair target or to form a groove corresponding to the cover plate is not required. For this reason, it is possible to repair the plate member in a short time and at low cost while securing the cooling performance of the cooling air passage.

Further, even in a case where an access direction of a tool for forming an opening is limited to only a direction from the casing chamber 57 side of the shell plate 3, the repair method according to the above-described embodiment can be used.

Further, the step of forming the first opening P4 and the step of forming the second opening P5 can be easily and reliably carried out by specifying places where the first cooling hole 13 and the second cooling hole 14 are provided, by referring to the position of the cooling air passage 7 exposed in advance.

Further, it is also possible to apply the repair method of a plate member according to the above-described embodiment to a ring segment of the gas turbine 100.

Figure 11:
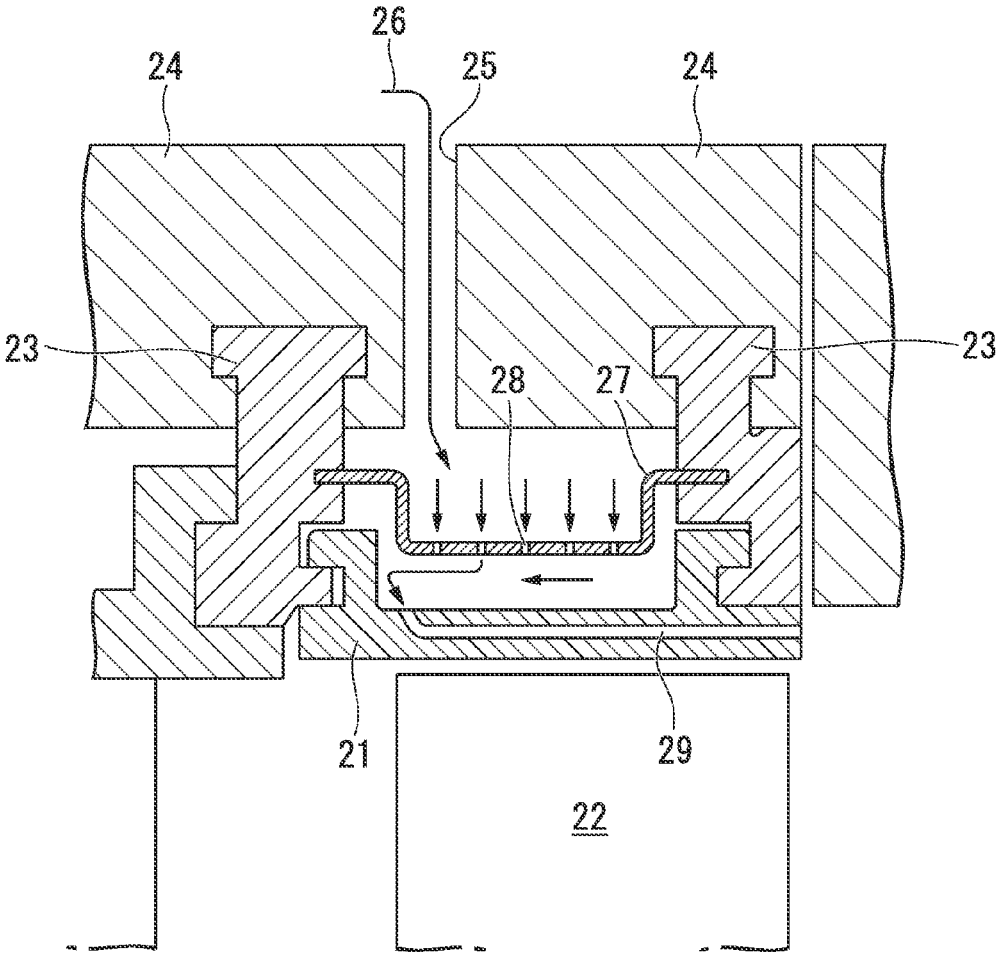
FIG. 11 is an enlarged view of portion B of FIG. 1.

As shown in FIG. 11, a ring segment 21 is divided into multiple members and installed on the outer periphery side, that is, the outside in the radial direction of a blade 22. A blade ring 24 is provided radially outside the ring segment 21 with an isolation ring (a heat-resistant portion) 23 interposed therebetween. A flow path 25 which is opened toward the ring segment 21 is formed in the blade ring 24, and in the flow path 25, air supplied from an air supply source (not shown) provided outside the gas turbine 100 or air extracted from the compressor 51 flows in the direction of an arrow 26 as a cooling medium.

Further, an impingement plate 27 is mounted on the isolation ring 23. The impingement plate 27 is disposed between the blade ring 24 and the ring segment 21 and has a plurality of cooling holes 28 for the passage of air blown out from the flow path 25 to the outer peripheral surface (the peripheral surface on the outside in the radial direction) of the impingement plate 27.

Then, a cooling air passage 29 of the ring segment 21 is provided so as to extend approximately parallel to an axial direction inside of the ring segment 21 from the upstream side (the left side in FIG. 11) of the axial direction of the outer peripheral surface of the ring segment 21 and penetrate to an end face on the downstream side of the axial direction. (In FIG. 11, only one cooling air passage is shown. However, a plurality of cooling air passages 29 is disposed in a row in a direction perpendicular to the plane of paper.)

The repair method according to the invention can also be similarly applied to a case where a crack has been generated in the ring segment 21 described above. In this case, the plate member according to the invention is a portion which includes the cooling air passage 29, of the ring segment 21.

In addition, the technical scope of the invention is not limited to the above-described embodiment and it is possible to add various changes thereto in a scope which does not depart from the gist of the invention.

Figure 12:
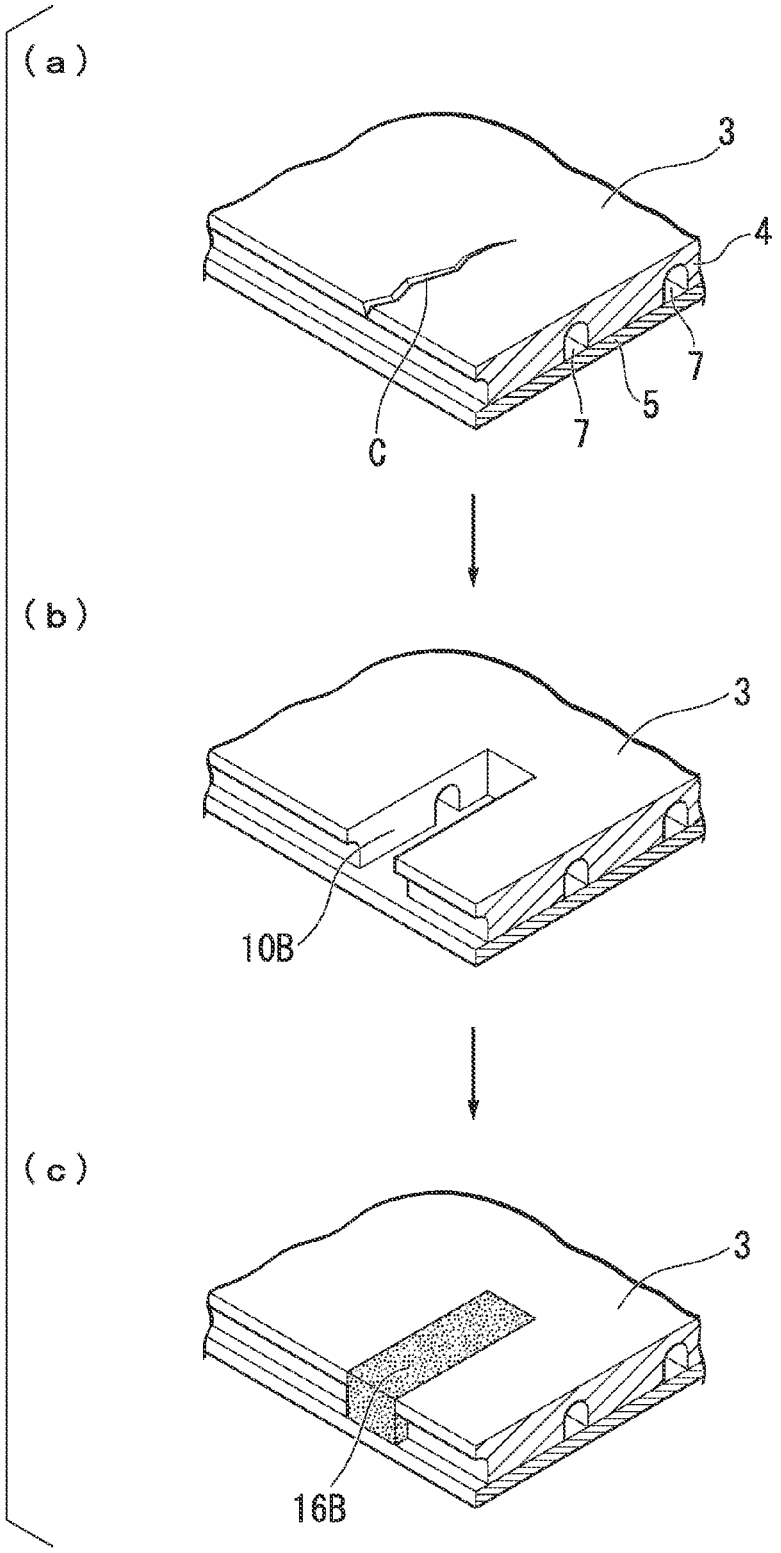
FIG. 12 is a diagram describing a repair method in a case where a crack is generated in only a surface layer of the shell plate.

For example, the long hole which is formed in the step P1 of removing the periphery of the crack C generated in the shell plate 3 is not limited to a through-hole. For example, as shown in FIG. 12A, in a case where the crack C is formed on only the outer shell plate 4 side of the shell plate 3, a long hole 10B is formed on only the outer shell plate 4 side and need not pass through both surfaces of the shell plate 3, as shown in FIG. 12B. In this way, as shown in FIG. 12C, since weld metal 16B does not leak to the inner periphery side of the shell plate 3, work of the step of primary filling P3 becomes easy.

Figure 13A:
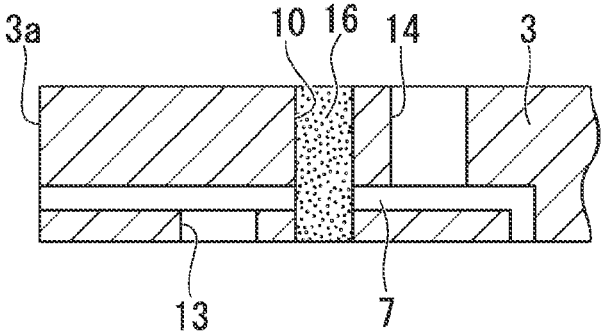
FIG. 13A is a cross-sectional view describing a repair method according to another embodiment of the invention.
Figure 13B:
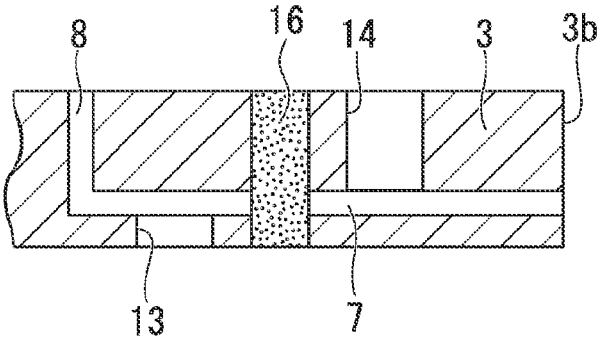
FIG. 13B is a cross-sectional view describing the repair method according to another embodiment of the invention.
Figure 13C:
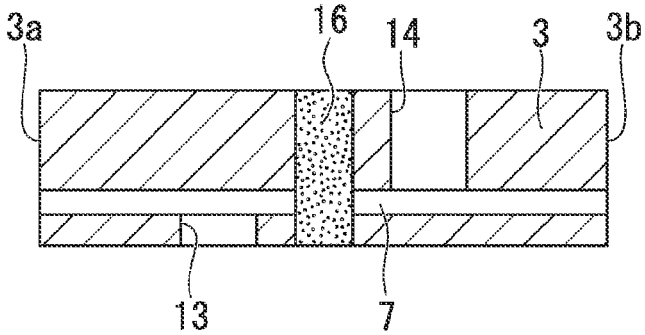
FIG. 13C is a cross-sectional view describing the repair method according to another embodiment of the invention.

Further, the cooling air inlet 8 and the cooling air outlet 9 need not necessarily be respectively opened to the casing chamber 57 side and the combustion chamber 60 side. For example, as shown in FIGS. 13A, 13B, and 13C, a structure is also acceptable in which cooling air flows in or flows out from end faces 3*a* and 3*b* of a plate member (the shell plate 3), and this is a matter that should be appropriately designed based on a place where the plate member (the shell plate 3) is used.

Further, the first cooling hole 13 and the second cooling hole 14 may also be formed before the step of removing P1, that is, before the crack C is removed. In this case, it is necessary to use a diagnostic device capable of estimating the position of the cooling air passage without destroying the plate member, by using an X-ray, an ultrasonic wave, or the like.

Further, a configuration is also possible in which after the step of removing P1 is performed, the step of forming the first opening P4 is performed with the step of marking P2 omitted, and thereafter, the step of primary filling P3, the step of forming the second opening P5, and the step of secondary filling P6 are performed. In this case, in the step of forming the first opening P4, positioning is performed while visually observing the cooling air passage 7 exposed by the step of removing P1.

Figure 14:
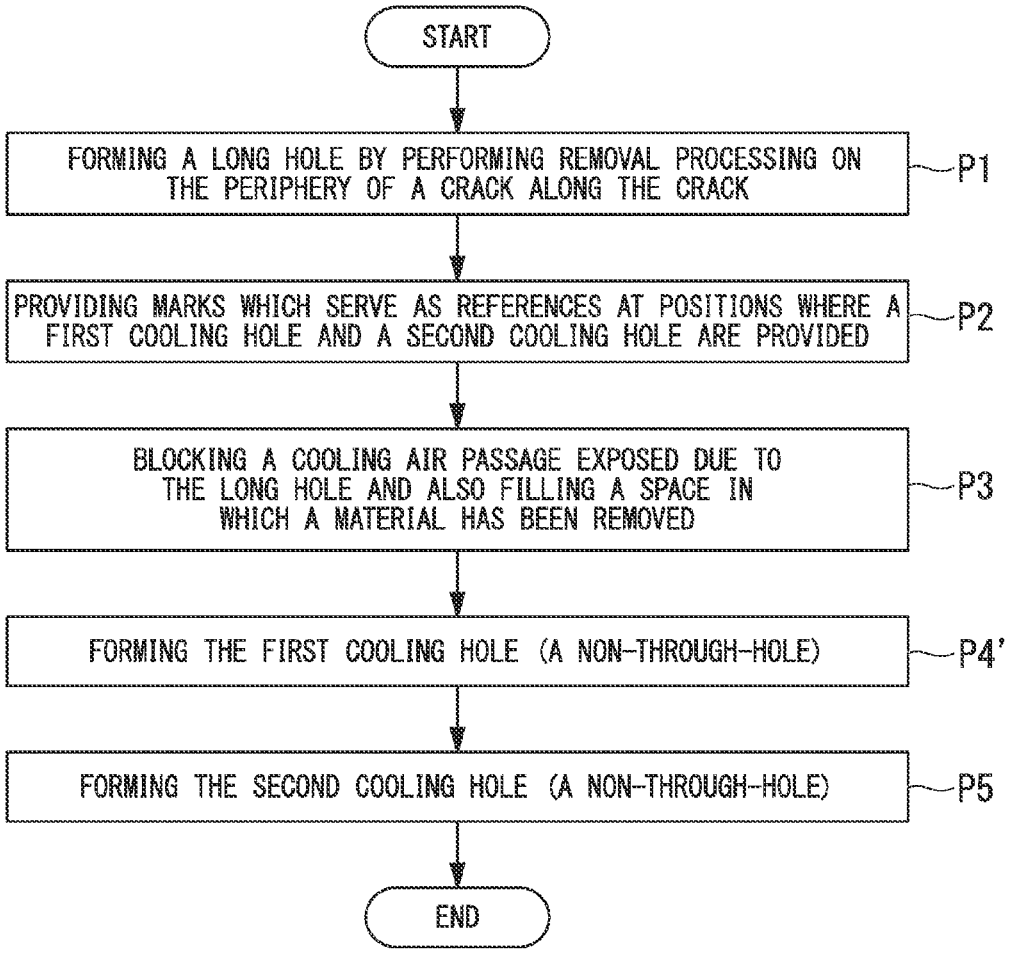
FIG. 14 is a flowchart of the repair method according to another embodiment of the invention.

Further, in a case where access is possible from both sides of a plate member, in particular, such as a case where the repair method according to the invention is applied to a ring segment, as shown in a flowchart of FIG. 14, a through-hole is not formed in the step of forming the first opening P4' and a hole extending only to the position of the cooling air passage 7 is provided, and thus the step of secondary filling P6 may be omitted. By performing repair in this manner, it is possible to further reduce the labor of work.

INDUSTRIAL APPLICABILITY

The invention can be used in the repair of a plate member disposed so as to separate a high-pressure space and a low-pressure space and having a cooling passage provided inside thereof along a surface of the plate member, particularly, a plate member of a gas turbine, or a combustor or a ring segment of the gas turbine.

REFERENCE SIGNS LIST

1: combustor
2: transition piece
3: shell plate (plate member)
7: cooling air passage (cooling passage)
10: long hole (area)
11: first mark (marking)
12: second mark (marking)
13: first opening (first cooling hole)
13*a*: communication portion (first opening)
14: second opening (second cooling hole)
16: weld metal (filling member)
17: weld metal (blocking member)
21: ring segment
57: casing chamber (high-pressure space)
60: combustion chamber (low-pressure space)
100: gas turbine
C: crack (damaged portion)

The invention claimed is:

1. A repair method of a plate member disposed so as to separate a high-pressure space and a low-pressure space, the plate member having a cooling passage extending inside of the plate member, the repair method comprising the steps of:

removing a damaged portion in the plate member so as to expose the cooling passage, and forming a long hole which communicates with the cooling passage and at least one of the high-pressure space and the low-pressure space;

primarily filling the long hole with a filling member made of a material different from that of the plate member, and form an external shape of the plate member having no missing portion as compared to an original external shape of the plate member;

forming a first opening on the low-pressure space side of the plate member and through which the cooling passage is communicated with the low-pressure space on an upstream side of the filling member in a flow direction of a refrigerant flowing in the cooling passage; and forming a second opening on the high-pressure space side of the plate member and through which the cooling passage is communicated with the high-pressure space on a downstream side of the filling member in the flow direction of the refrigerant flowing in the cooling passage, wherein the filling member blocks the cooling passage to prevent the refrigerant flowing between the first opening and the second opening.

2. The repair method of a plate member according to claim 1, wherein in the step of forming the first opening, the first opening is provided by forming a through-hole that penetrates from a surface on the high-pressure space side of the plate member to a surface on the low-pressure space side of the plate member, and the repair method further includes the step of secondarily filling and blocking a portion through which the high-pressure space is communicated with the cooling passage in the through-hole.

3. The repair method of a plate member according to claim 1, further comprising the step of:

marking on positions where the first and second openings are to be formed, wherein the step of marking is performed between the steps of removing and primary filling.

4. A plate member disposed so as to separate a high-pressure space and a low-pressure space, the plate member comprising:

a filling member made of a material different than the plate member;

a cooling passage extending inside the plate member;

a first opening formed on the low-pressure space side of the plate member and through which the cooling passage communicates with the low-pressure space on an upstream side of the filling member in a flow direction of a refrigerant flowing in the cooling passage;

a second opening is formed on the high-pressure space side of the plate member and through which the cooling passage communicates with the high-pressure space on a downstream side of the filling member in the flow direction of the refrigerant flowing in the cooling passage; and a long hole communicating with the cooling passage and at least one of the high-pressure space and the low-pressure space, wherein the filling member plugs the long hole and blocks the cooling passage to prevent the refrigerant flowing through the cooling passage between the first opening and the second opening.

5. The plate member according to claim 4, wherein the first opening is a through-hole in the plate member extending from the low-pressure side of the plate member to the high-pressure side of the plate member, and the plate member further comprising a blocking member plugging a portion of the through-hole to block communication of the cooling passage with the high-pressure side of the plate member.

6. A combustor of a gas turbine comprising the plate member according to claim 4.

7. The combustor of a gas turbine according to claim 6, wherein the combustor includes the plate member having a tubular shape, the plate member includes a plurality of plates which includes at least one plate with a groove provided on a surface thereof defining the cooling passage, the high-pressure space is a space inside of a casing of the gas turbine and outside of the combustor, and the low-pressure space is a space inside of the combustor.

8. A ring segment comprising the plate member according to claim 4.

9. A ring segment comprising the plate member according to claim 5.

10. A gas turbine comprising the combustor according to claim 6.

11. A gas turbine comprising the combustor according to claim 7.

12. A gas turbine comprising the ring segment according to claim 8.

13. A gas turbine comprising the ring segment according to claim 9.

* * * * *